US006253058B1

(12) United States Patent
Murasaki et al.

(10) Patent No.: US 6,253,058 B1
(45) Date of Patent: Jun. 26, 2001

(54) INTERACTIVE TOY

(75) Inventors: Keiichi Murasaki; Tatsuya Matsuzaki, both of Tokyo (JP)

(73) Assignee: Toybox Corporation, Tokyo (JP)

( * ) Notice: Subject to any disclaimer, the term of this patent is extended or adjusted under 35 U.S.C. 154(b) by 0 days.

(21) Appl. No.: 09/409,897

(22) Filed: Oct. 1, 1999

(30) Foreign Application Priority Data

Mar. 11, 1999 (JP) ..... 11-065604

(51) Int. Cl.[7] ..... A63F 9/22
(52) U.S. Cl. ..... 434/308; 446/175
(58) Field of Search ..... 446/297–298, 446/300–301, 397, 175, 268, 270; 434/308, 307 R; 463/1, 30, 36, 40, 42, 35

(56) References Cited

FOREIGN PATENT DOCUMENTS 6-134145 5/1994 (JP) .

*Primary Examiner*—Mark Sager
(74) *Attorney, Agent, or Firm*—Swidler Berlin Shereff Friedman LLP

(57) ABSTRACT

An interactive toy that can display emotional expressions in accordance with the degree of friendliness between the user and the toy, comprising a detector for detecting an external stimulation which is a stimulation by a movement and converting it into an electric signal and an output for outputting data stored in a storage section by the electric signal sent from the detector, wherein the data so outputted are data with respect to sound, and the toy reacts with audio.

8 Claims, 6 Drawing Sheets

INTERACTIVE TOY

BACKGROUND OF THE INVENTION

The present invention relates to an interactive toy adapted to display emotions in accordance with the degree of friendliness established between the user and the toy. This general kind of toy is shown in Japanese Unexamined Patent Publication No. HEI 6-134145. This example relates to a doll that can learn through combination and interaction of speeches and touches by the user. In other words, the example relates to a doll which is constructed to learn from being kissed and/or spoken to by a child user. In such a toy, a doll is given a learning feature. But, what is needed is a toy that can play a role of a pet for which a child user can have love.

SUMMARY OF THE INVENTION

The present invention was made to solve the problems inherent in the prior art, and an object thereof is to provide an interactive toy that can react to and display its emotions in accordance with the degree in which it is treated with love.

An object of the invention is to provide a toy that, when the user moves the toy, for instance, when it is laid down, the toy is switched from a normal mode (wake-up mode) to a sleep mode, when it gives a speech such as "Good night," and when it is caused to get up, the toy is switched back to the wake-up mode, when it gives a speech such as "Good morning."

Another object of the invention is to provide a toy that is constructed such that when the toy is moved, a weight moves leftward or rightward to change over the switch, and when it is laid down, the toy is switched from the normal mode to the sleep mode, and on the contrary, when it is caused to get up, the toy is easily switched from the sleep mode to the normal mode (wake-up mode), the toy being adapted to speak words matching its movements. Further, when the toy is laid down, it is switched to a sleep mode through a movement of a weight, and on the contrary, when it is switched from a sleep mode to a normal mode (wake-up mode), the toy may not be switched through a changeover of switch but controlled by internal logic circuitry, such as a microcomputer.

A further object of the invention is to provide a toy that counts the number of vibrations received thereby and changes its speeches to the user thereof in accordance with the number of vibrations so counted to eventually speak friendly words.

Still a further object of the invention is to provide a toy that tracks the number of vibrations given to the toy by using a vibration sensor using a metallic ball, whereby the number of vibrations so counted is accurately metered.

Still a further object of the invention is provide a toy including a light emitting diode that is constructed to emit light continuously or intermittently in accordance with the degree in which the toy is treated with love, whereby the degree of love is visually judged.

DESCRIPTION OF THE PREFERRED EMBODIMENTS

Figure 1:
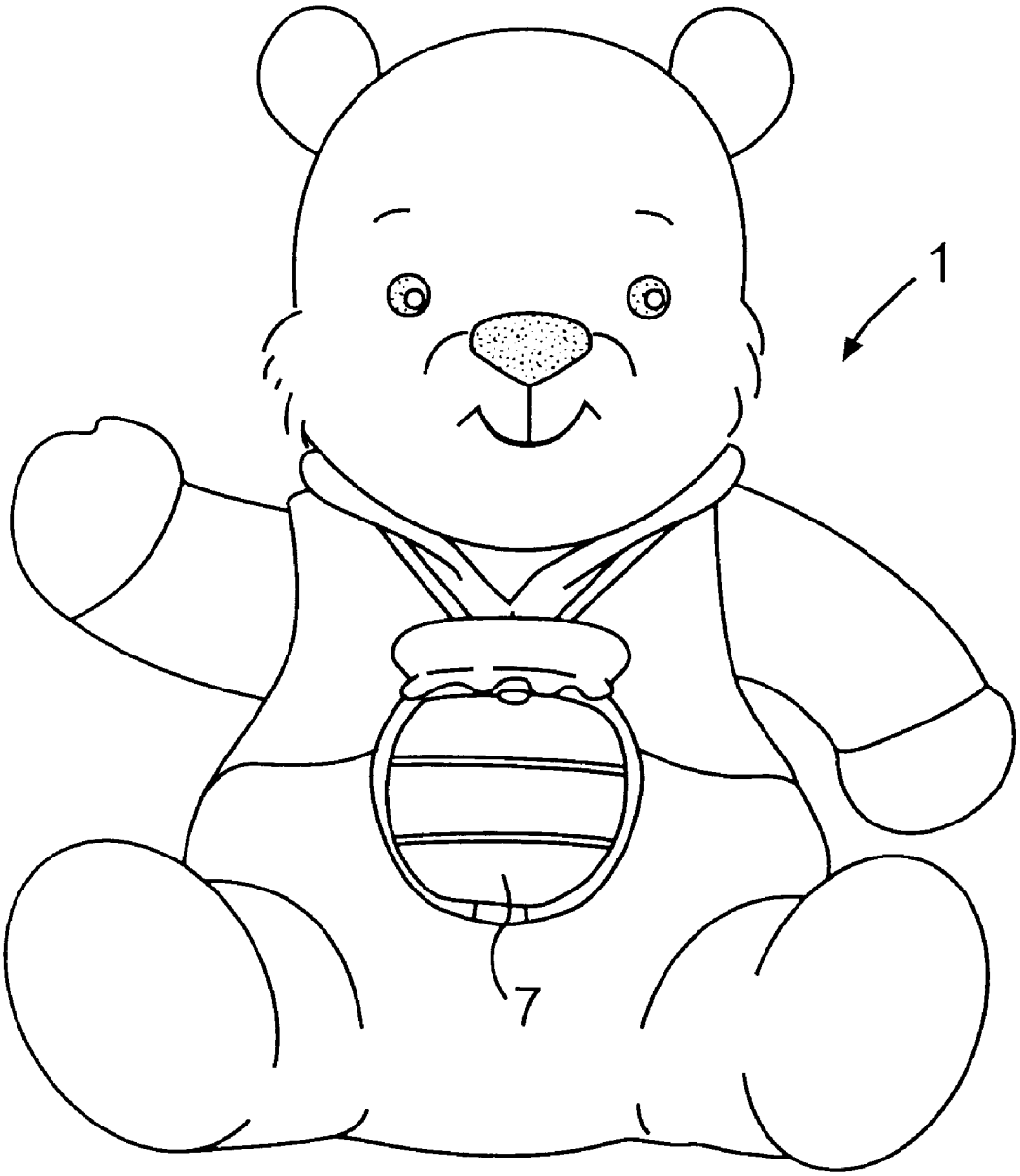
FIG. 1 is a drawing showing a stuffed toy to which the present invention is applied.

FIG. 1 shows an embodiment of the present invention applied to a stuffed toy, which is provided in a main body 1 thereof with a voice detector, an audio generator, a vibration detector, a movement detector and a microcomputer 6 for controlling these constituent components.

In addition, as shown in FIG. 1, a container-type light emitter 7 is provided on a front side of the main body 1 of the stuffed toy. When the user of the toy calls thereto with his or her own voice or lays down the toy to switch it to a sleep mode, the toy reacts to such external stimulation by generating audio such as speech.

Figure 2:
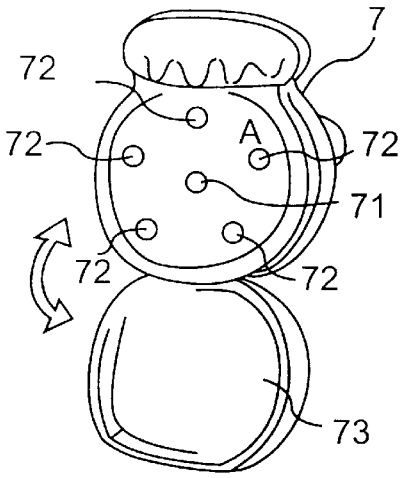
FIG. 2 is a drawing showing an internal construction of a container according to the present invention.

FIG. 2 shows an embodiment of the internal construction of the container used in the present invention. When a lid 73 is opened toward the user, there is built therein a microphone 71, and the user of the toy is supposed to call thereto with his or her own voice through this microphone. It is desirable to use a condenser microphone to have quality sound and eliminate noise through the microphone. There are five light emitting portions 72 provided on the outer circumference of the microphone 71, and the user treats the toy with love like a pet, light emitting diodes (LED) start to emit light from the right-hand side in a clockwise direction step by step through the electronic control by the microcomputer 6, as will be described later. When all the light emitting portions are illuminated, the user makes an intimate friend of the toy. The number of light emitting diodes (LED) is not limited to five, but any number of light emitting diodes may be used, and there may be provided 12 light emitting diodes like the dial of a clock.

Figure 3:
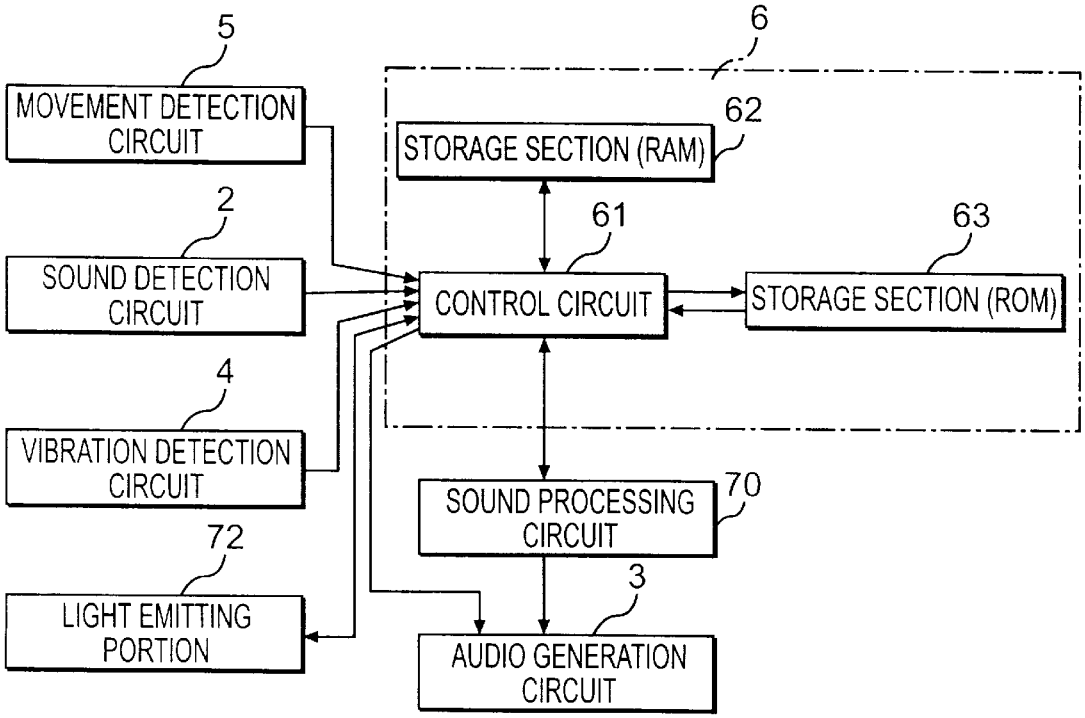
FIG. 3 is a block diagram showing a control circuit of the present invention.

FIG. 3 is a block diagram of a control circuit for detecting external stimuli to the toy such as sound vibrations and movements of the toy, and for controlling outputs from the toy such as light and sound. It is not necessary to the present invention that each of movement, vibration and/or sound be detected. Instead, in accordance with the present invention, it is sufficient to detect a single stimulus from a user of the toy. FIG. 3 shows a circuit for controlling sound. This circuit is used when the user speaks with the toy, and a sound sensor is used to detect the sound as an external stimulation of the toy. Thus, a sound detection circuit 2 detects sound such as a voice. A control circuit 61 detects an electric signal that results from a signal conversion and sends the signal so detected to a storage section or memory element 63. The memory element can comprise any suitable memory such as a read only memory (ROM), random access memory (RAM) that can have a battery back up or any other such suitable memory element. The control circuit 61 obtains the following operation procedure from the memory element 63, sends the electric signal to a sound processing circuit 70 for generation of audio through an audio generation circuit 3. In this case, what the toy speaks is a speech representative of audio data stored in the memory element 63 and reproduced through a speaker.

Figure 4:
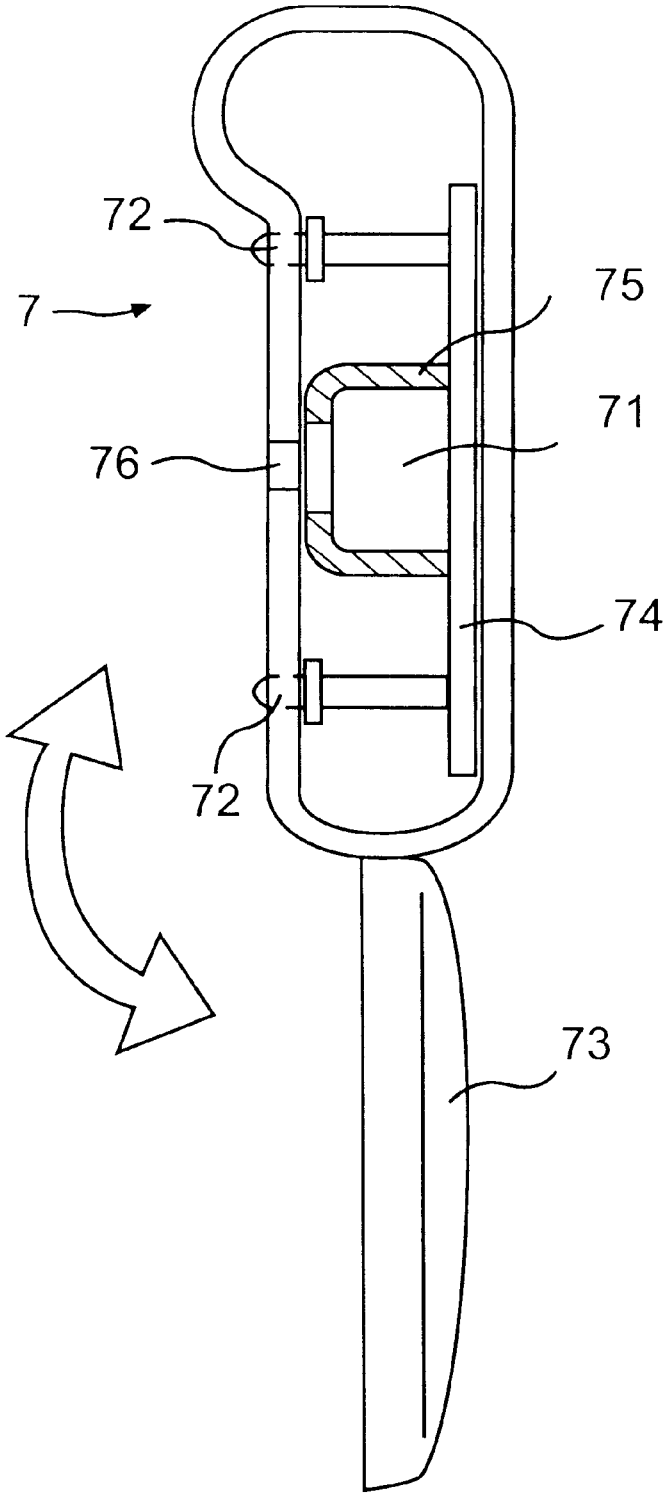
FIG. 4 is a drawing showing an embodiment of a light-emitting portion of the present invention.

FIG. 4 shows an embodiment of the light-emitting portion as the light emitting means of the present invention. In the container-type light emitting means 7, with the lid 73 being opened toward the user, there are a plurality of light emitting diodes disposed on a base plate 74, and the condenser microphone 71 covered with a rubber case 75 is disposed on this base plate. There is an opening 76 formed in front of the condenser microphone 71, and when the user of the toy speaks thereto toward the opening 76, the voice of the user is picked up by the condenser microphone 71, which sends in turn an electric signal generated from the voice so picked up to the control circuit 61. The invention is not limited to light emitting diodes, and any low power light source can be used, especially those designed to be powered by the type of batteries commonly used in toys.

The following describes a circuit that controls vibrations in an embodiment of the present invention. This circuit stores the number of vibrations given to the toy in a cumulative fashion, and the toy delivers a new speech step by step in accordance with the number of vibrations counted. For instance, if the child user takes the toy for a walk or play with it in the room, vibrations are generated and counted in a cumulative fashion. Thus, the child user and the toy makes intimate friends with each other, and speeches exchanged between them become more friendly. In the present invention, the vibration sensor is used as a means for detecting vibrations which are external stimulation, and vibrations of the toy are then detected by a vibration detecting circuit 4. A signal, which is converted into an electric signal, is detected by the control circuit 61, which sends the signal to the memory element 63. The control circuit 61 obtains the following operation procedure from the memory element 63, in other words, an instruction to read a rewritable portion of a RAM 62, which is a storage section. Then, the control circuit 61 reads in data in the rewritable section of the RAM 62 and updates the data. The update can use the data stored in the memory element 63. Thereafter, the control circuit 61 reads out data stored in the memory element 63 for operation and obtains an instruction to write the result of the operation in the RAM 62, performs this instruction and executes rewriting of the RAM 62. The RAM 62 can comprise any suitable read-write memory circuit.

The number of vibrations is counted by following the aforesaid series of flows. In the present invention, when the number of vibrations is small, the toy is programmed to speak only a limited number of speeches, and as the number of vibrations counted increases, the toy is constructed to speak additional new speeches. The indication of the degree of the user's love for the toy can be represented by the number of light emitting diode in operation. When the toy is first used, there is only one light emitting diode in operation, i.e., emitting light. Then, for instance, when the number of vibrations counted reaches 1000, the second light emitting diode is constructed to start to emit light. In this case, in a state in which the toy is normally used, since the lid of the light emitting means 7 is closed, the user of the toy cannot be aware of the degree of his or her love for the toy. Although the second light emitting diode is constructed to start to emit light when the number of vibrations counted reaches 1000, if it is programmed so a~to emit light intermittently while the number of vibrations stays from 1000 to 1200 and emit light continuously until the number of vibrations reaches 2000 after it exceeds 1200, the user of the toy can easily get to know the degree of his or her; Love for the toy at the time when the lid is opened.

Next, a circuit of the present invention will be described which controls the operation thereof. In this circuit, when the user lays the toy down from a seated state (normal mode), a pose sensor is actuated five seconds thereafter and the toy is switched to a sleep mode and speaks words such as "Good night." Then, when the user speaks to it, the toy performs suitably to the sleep mode such as snoring or talking in sleep. The toy is also programmed to deliver a speech such as "I've had a good sleep," when the user raises it to be seated. In the present invention, the pose sensor is used as a means for detecting a movement as an external stimulation, and a movement of the toy is detected by a movement detection circuit 5. The control circuit 61 detects a signal, which is then converted into an electric signal and sends the signal so detected to the memory element 63. The control circuit 61 obtains the following operation procedure from the memory element 63, sends the electric signal to a sound processing circuit 70 and produces audio via the audio generation circuit 3. In this case, what the toy speaks through a speaker is a speech representative of data stored in the memory element 63.

Figure 5:
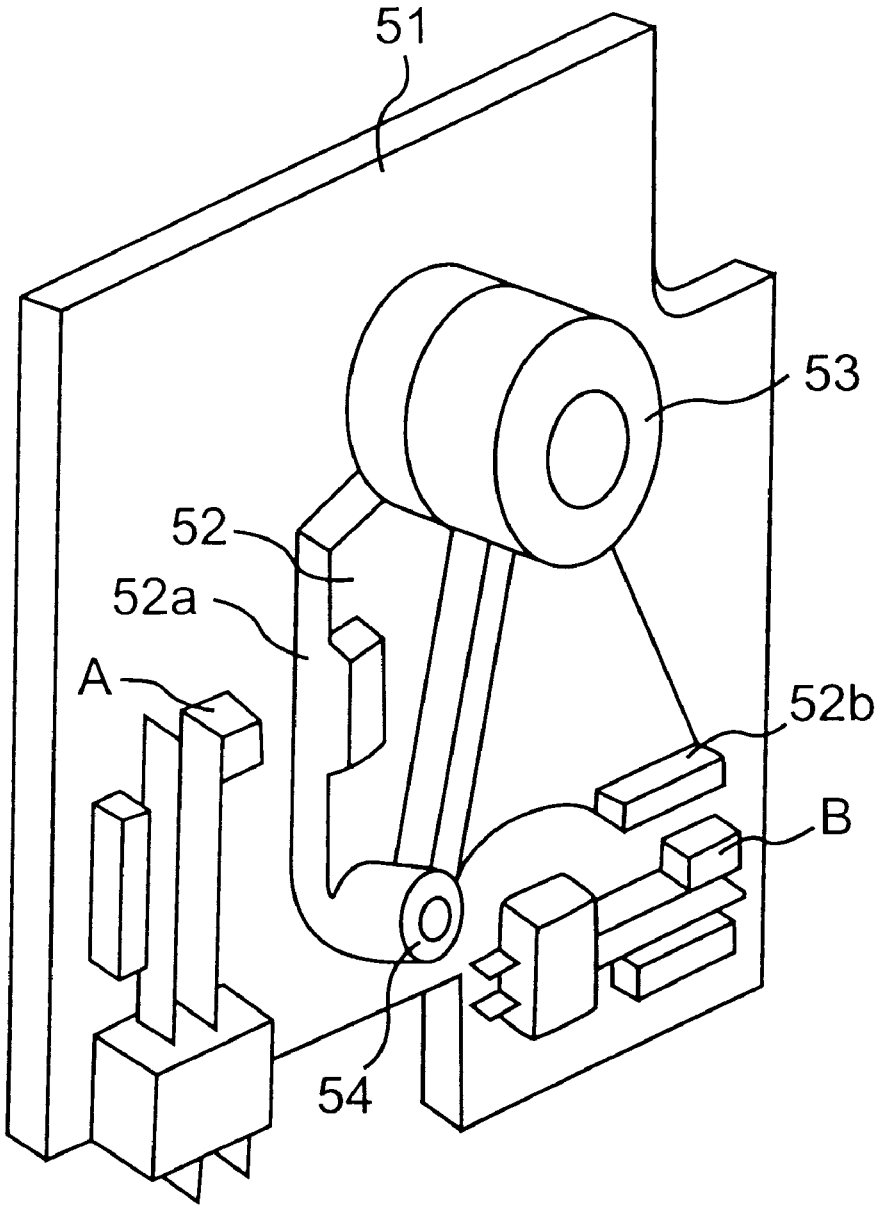
FIG. 5 is a drawing showing an embodiment of a pose sensor according to the present invention.
Figure 6:
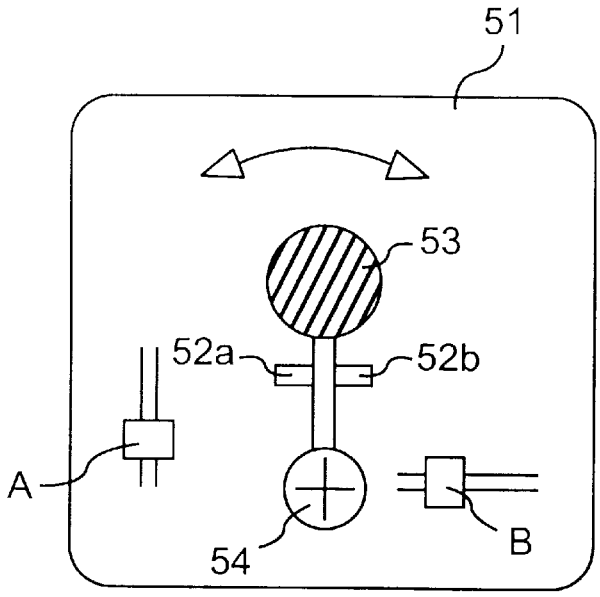
FIG. 6 is a drawing showing the embodiment of the pose sensor according to the present invention.

FIGS. 5 and 6 show an embodiment of the pose sensor according to the present invention. A swingable plate 52 is provided on a sensor base plate 51, and a weight 53 is mounted at a distal end of the swingable plate 52 in such a manner as to freely swing left and right around a shaft 54 functioning as a fulcrum. In a state in which the toy is seated, a sidewall 52*a* of the swingable plate 52 is in contact with a switch A, and the toy is put in a normal mode (wake-up mode). On the contrary, when the toy is inclined so as to be laid down, a projection 52*b* of the swingable plate is brought into contact with a switch B, and the program of the toy is then switched to a sleep mode.

Figure 7A:
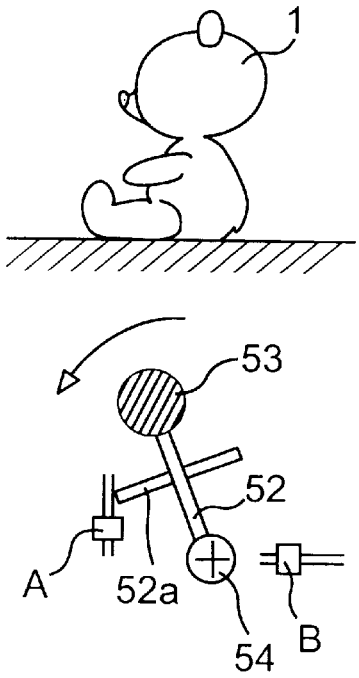
FIG. 7*a* is a drawing showing a switch portion for a wake-up mode of the present invention.
Figure 7B:
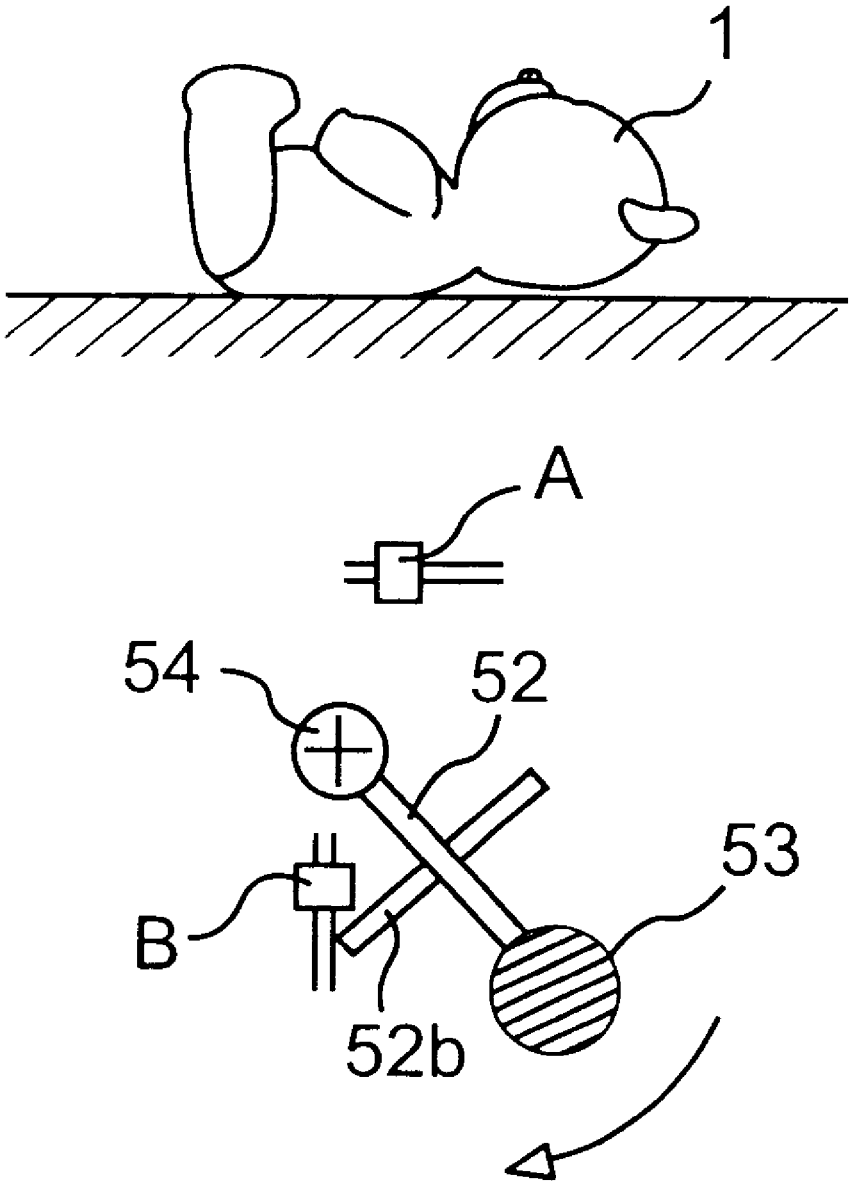
FIG. 7*b* is a drawing showing a switch portion for a sleep mode of the present invention.

FIGS. 7*a* and 7*b* are also drawings showing the pose sensor in an embodiment of the present invention. FIG. 7*a* shows a state in which the toy is raised and seated, and the weight 53 is inclined to the switch A side, whereby the side wall 52*a* of the swingable plate 52 is in contact with the switch A. In this state, the toy is in the normal mode (wake-up mode) and can speak with the user at random. Thereafter, the toy is laid down as shown in FIG. 7*b*, the weight 53 is inclined toward the switch B side, and the projection 52*b* of the swingable plate 52 is brought into contact with the switch B, whereby the toy is switched to the sleep mode.

In the present embodiment, two switches which construct the pose sensor are provided, however, the pose sensor can be constructed of one switch. In other words, when the toy is laid down, it is switched to a sleep mode through a movement of a weight; on the contrary, when it is switched from a sleep mode to a normal mode (wake-up), it can be controlled by the microcomputer 6.

In addition, in the normal mode, when the toy is left not treated with love (not spoken to or not cared for), say, 30 minutes, the toy appeals to the user for care, saying, "Let's play," or "It's boring." Furthermore, if the toy is not taken care of after such an appeal is made, the count of the vibrations goes back to zero, and the contents of the speech are also restored to the initial state, the number and state of the light emitting diodes returning to the initial level A.

Furthermore, toys according to the present invention can be placed face to face to talk to each other. In other words, when their sound sensors detect words spoken by people or noise therearound, both the toys start to speak. The contents of speeches are constructed at random and they are short or long. When one of the toys finishes speaking, the other starts to speak, and the other toy reacts thereto through the sound sensor and then starts to speak again, whereby the conversation between them continues like this.

The present invention is carried out in the mode described above, and provides the following advantages. The present invention provides an interactive toy in which when the user moves it, the toy can speak and display emotions in such a manner matching the treatment by the user. In addition, the present invention provides the interactive toy in which the number of vibrations received by the toy is counted, whereby the toy can change the speeches and display different emotional expressions in accordance with the number of vibrations counted.

Furthermore, the present invention provides the interactive toy in which the number of vibrations given to the toy is counted, whereby the toy can indicate the degree of love for the toy in accordance with the number of vibrations so counted.

What is claimed is:

1. An interactive toy comprising:

detection means for detecting at least one external stimulus to the toy and for providing at least one electric signal in response to the detection;

a memory element connected to store data representative of a number of at least some of the external stimulus detected by the detection means;

a control circuit operatively coupled to the detection means and to the memory element and to provide at least one output signal responsive to the data; and output means for providing at least one output responsive to the at least one output signal.

2. An interactive toy as set forth in claim 1, wherein the detection means includes:

a weight positioned to move in response to movement of the toy; and a movement detection circuit connected to provide an electric signal responsive to movement of the weight.

3. An interactive toy as set forth in claim 1, wherein the memory element stores data representative of the number of detections by the detection means; and stores data with respect to sound and light.

4. An interactive toy as set forth in claim 3, wherein the detection means includes a movable member housed within a case.

5. An interactive toy as set forth in claim 3, further comprising a light-emitting element connected to emit light in response to an output of the memory element.

6. An interactive toy as set forth in claim 1, wherein the detection means includes at least one of a movement detector connected to detect an external stimulus comprising at least a position of the toy, a sound detector connected to detect an external stimulus comprising at least some of the sounds reaching the toy, and a vibration detector connected to detect an external stimulus comprising vibrations of the toy.

7. An interactive toy as set forth in claim 6, wherein the memory element stores data representative of a number of at least one of the position of the toy, sounds reaching the toy and vibrations of the toy, as detected by the detection means.

8. An interactive toy as set forth in claim 7, wherein the output means outputs at least one of light and sound responsive to the at least one output signal.

* * * * *